US007258461B1

(12) United States Patent
Izardel

(10) Patent No.: US 7,258,461 B1
(45) Date of Patent: Aug. 21, 2007

(54) VEHICLE BARRIER WITH LIGHT

(75) Inventor: Lazar Izardel, Tel Aviv (IL)

(73) Assignee: Gamasonic Ltd., Tel Aviv (IL)

( * ) Notice: Subject to any disclaimer, the term of this patent is extended or adjusted under 35 U.S.C. 154(b) by 0 days.

(21) Appl. No.: 11/620,680

(22) Filed: Jan. 7, 2007

(51) Int. Cl.
*F21V 33/00* (2006.01)

(52) U.S. Cl. ..... 362/152; 49/49; 52/28; 52/33; 52/174; 52/73; 362/253; 362/183

(58) Field of Classification Search ..... 362/152, 362/145, 253, 183; 49/49; 52/28, 32, 33, 52/174, 73, 74
See application file for complete search history.

(56) References Cited

U.S. PATENT DOCUMENTS 4,916,859 A * 4/1990 Butler ..... 49/9
6,487,818 B1 * 12/2002 Hamann et al. ..... 49/49
6,618,993 B2 * 9/2003 Burke ..... 49/49

* cited by examiner

*Primary Examiner*—Laura Tso
(74) *Attorney, Agent, or Firm*—Dekel Patent Ltd; David Klein

(57) ABSTRACT

A vehicle barrier arranged for moving from a first position that permits a vehicle to move past the vehicle barrier to a second position that prevents a vehicle from moving past the vehicle barrier, and a light mounted on the vehicle barrier that moves with the vehicle barrier, wherein when the vehicle is in the first position the light is illuminated in a first color (e.g., green) and in the second position the light is illuminated in a second color (e.g., red).

11 Claims, 2 Drawing Sheets

VEHICLE BARRIER WITH LIGHT

FIELD OF THE INVENTION

The present invention relates generally to barriers that bar or control passage of vehicles (e.g., at entrances to parking spaces or parking lots, barriers at railroad crossings or toll booths the like), and particularly to such a barrier with a light.

BACKGROUND OF THE INVENTION

There are many vehicle barriers that are used to prevent access to parking spaces or parking lots or passage to restricted areas, just to name a few examples.

SUMMARY OF THE INVENTION

The present invention seeks to provide a novel vehicle barrier with a light, as is described hereinbelow.

There is thus provided in accordance with an embodiment of the present invention a vehicle barrier arranged for moving from a first position that permits a vehicle to move past the vehicle barrier to a second position that prevents a vehicle from moving past the vehicle barrier, and a light mounted on the vehicle barrier that moves with the vehicle barrier, wherein when the vehicle is in the first position the light is illuminated in a first color (e.g., green) and in the second position the light is illuminated in a second color (e.g., red).

The vehicle barrier can include one or more of the following features. For example, the vehicle barrier may be movable to an intermediate position that partially prevents a vehicle from moving past the vehicle barrier, and when the vehicle barrier is in the intermediate position the light is illuminated in a third color (e.g., amber).

The light may be solar powered and a solar cell may be provided for powering the light.

The vehicle barrier may be pivoted such that when the vehicle barrier is in a vertical position a vehicle can move past the vehicle barrier.

Alternatively, the vehicle barrier may be pivoted such that when the vehicle barrier is in a non-vertical position a vehicle can move past the vehicle barrier.

BRIEF DESCRIPTION OF THE DRAWINGS

The present invention will be understood and appreciated more fully from the following detailed description, taken in conjunction with the drawings in which:

FIGS. 1A, 1B and 1C are simplified pictorial illustrations of a vehicle barrier, constructed and operative in accordance with an embodiment of the present invention, wherein FIG. 1A shows the barrier in an upper position that does not bar passage of a vehicle therethrough, and in which a green light is illuminated, FIG. 1B shows the barrier in an intermediate position that partially bars passage of a vehicle therethrough, and in which an amber light is illuminated, and FIG. 1C shows the barrier in a lowermost position that bars passage of a vehicle therethrough, and in which a red light is illuminated;

DETAILED DESCRIPTION OF EMBODIMENTS

Figure 1A:
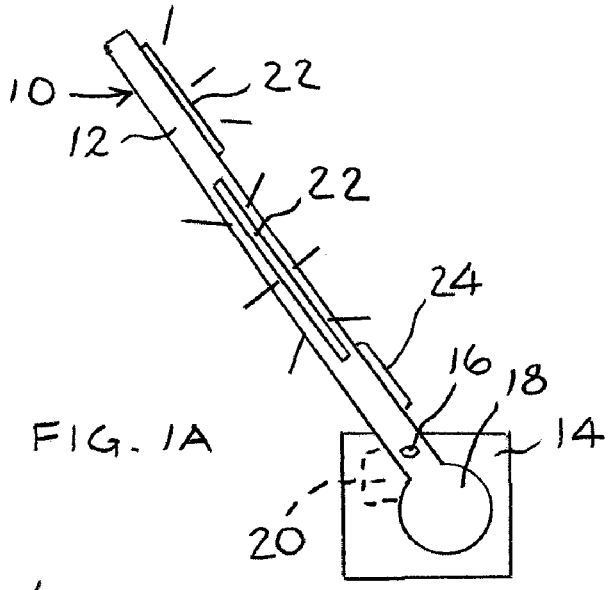
Figure 1B:
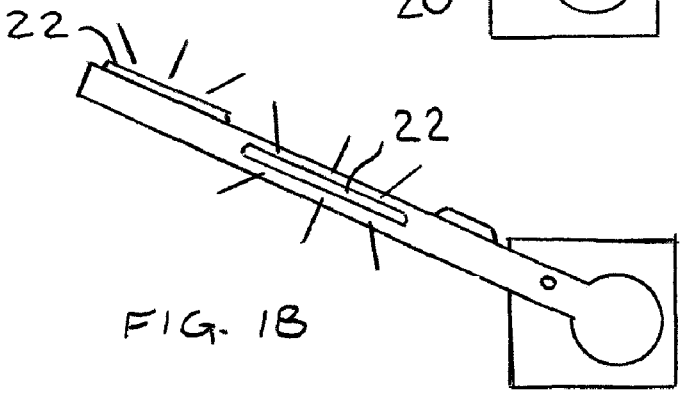
Figure 1C:
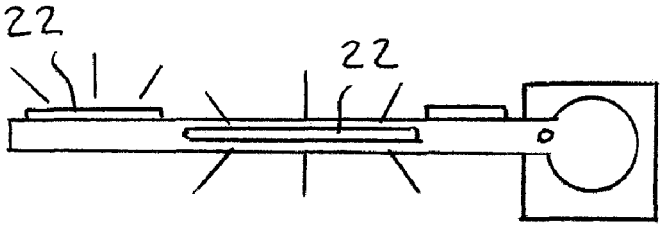

Reference is now made to FIGS. 1A-1C, which illustrate a vehicle barrier 10, constructed and operative in accordance with an embodiment of the present invention.

In the non-limiting illustrated embodiment, vehicle barrier 10 may be an elongate bar 12 pivoted to a console 14 at a pivot 16. Elongate bar 12 may have a counterweight 18 at the end nearest pivot 16 (on the opposite side of pivot 16). A motor 20 (or other suitable actuator) may be housed in console 14 for operating vehicle barrier 10. Motor 20 may be remote-controlled as is known in the art.

Vehicle barrier 10 may be arranged for moving from a first position (that of FIG. 1A, in this case vertical or nearly vertical) that permits a vehicle to move past the vehicle barrier 10 to a second position (that of FIG. 1C, in this case horizontal or nearly horizontal) that prevents a vehicle from moving past the vehicle barrier 10.

A light 22 may be mounted on the vehicle barrier 10 (e.g., on any surface of elongate bar 12, such as the surface facing a vehicle or on the top surface) that moves with the vehicle barrier 10 (i.e., with elongate bar 12). In the first position, light 22 is illuminated in a first color (e.g., green) and in the second position light 22 is illuminated in a second color (e.g., red). Light 22 may be vertical, horizontal or any other angular position.

The vehicle barrier may be movable to an intermediate position (that of FIG. 1B, in this case between vertical and horizontal) that partially prevents a vehicle from moving past vehicle barrier 10. When the vehicle barrier is in the intermediate position the light is illuminated in a third color (e.g., amber).

Light 22 may comprise an elongate light strip, such as that described in applicant's co-pending U.S. patent application Ser. No. 11/084,156, the disclosure of which is incorporated herein by reference. In such an example, light 22 includes a lamp distanced axially from a curved, reflective end of an elongate reflector. Light 22 may be powered by an electrical power source 24, such as but not limited to, DC power (e.g., from a battery, 6-12V) or AC power (e.g., 110-120 or 220-240 VAC) or a solar cell/solar collector (the latter being the preferred embodiment). The power source 24 may be mounted on vehicle barrier 10 in wired connection to light 22. Alternatively, power source 24 may be mounted on console 14 in wired connection to light 22, such as by means of slip rings. The light 22 may comprise, without limitation, LEDs or incandescent lights, and may have any size and color, and may be flashing or non-flashing.

In a preferred embodiment, light 22 comprises one or more LEDs arranged in any pattern, such as but not limited to, straight or curved. The LEDs may be of any size and mcd rating. It is preferable that light 22 is a color changing LED so that light 22 can be illuminated in the three "accepted traffic" colors mentioned above, namely, red, green, and amber. The change in illumination color can be effected by sensing the position of vehicle barrier 10. One way of accomplishing this is to provide vehicle barrier 10 with electrical contacts which contact another set of electrical contacts positioned at pre-defined angles about pivot 16. For example, when contact is made at or near the vertical position, the LED lights up green. At or near the horizontal position, the LED lights up red. In between the LED lights up amber. Another way of accomplishing this would be to use an encoder with motor 20 to sense the angles. Alternatively, the lights 22 may be remote-controlled by a user (e.g., guard or watchman).

Figure 2:
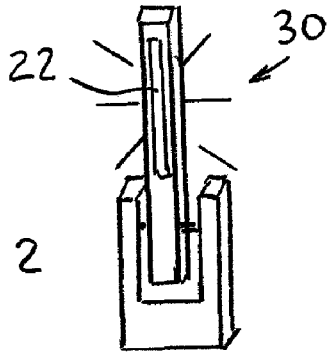
FIG. 2 is a simplified pictorial illustration of a vehicle barrier, constructed and operative in accordance with another embodiment of the present invention.

Reference is now made to FIG. 2, which illustrate a vehicle barrier 30, constructed and operative in accordance with another embodiment of the present invention.

Vehicle barrier 30 is constructed basically the same as vehicle barrier 10, except the way it is pivoted. Vehicle barrier 10 may be pivoted such that when vehicle barrier 10 is in the vertical position a vehicle can move past the vehicle barrier 10. In contrast, vehicle barrier 30 may be pivoted such that when vehicle barrier 30 is in a non-vertical position a vehicle can move past vehicle barrier 30. Vehicle barrier 30 is designed for restricting parking at a single parking space.

Figure 3:
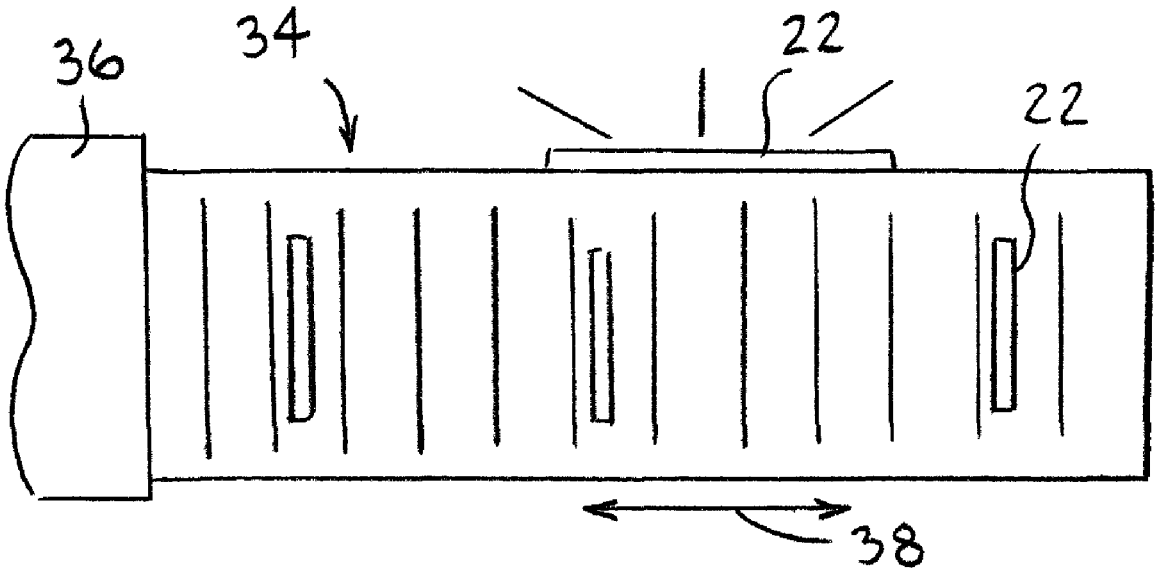
FIG. 3 is a simplified pictorial illustration of a vehicle barrier, constructed and operative in accordance with yet another embodiment of the present invention.

Reference is now made to FIG. 3, which illustrate a vehicle barrier 34, constructed and operative in accordance with another embodiment of the present invention.

Vehicle barrier 34 may be arranged for linear movement, for example, as a driveway barrier that slides (horizontally) in and out of a gate 36 in the direction indicated by double arrow 38. Any number of lights 22 may be mounted on vehicle barrier 34 on any surface thereof. In this embodiment, when vehicle barrier 34 is deployed outwards (e.g., blocking access to a driveway), light 22 may be illuminated red. When vehicle barrier 34 is moved inwards (e.g., does not block access to the driveway), light 22 may be illuminated green.

Figure 4:
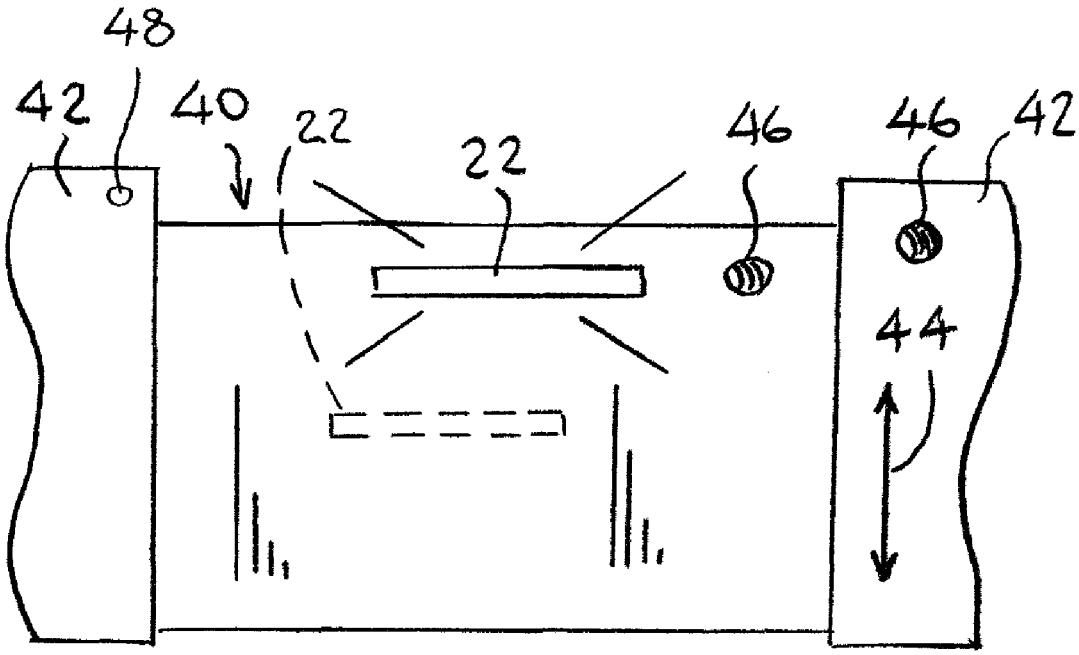
FIG. 4 is a simplified pictorial illustration of a vehicle barrier, constructed and operative in accordance with still another embodiment of the present invention.

Reference is now made to FIG. 4, which illustrate a vehicle barrier 40, constructed and operative in accordance with another embodiment of the present invention.

Vehicle barrier 40 may be arranged for linear movement, for example, as a garage barrier that slides up and down (vertically) along walls 42 in the direction indicated by double arrow 44. Any number of lights 22 may be mounted on vehicle barrier 40 on any surface thereof. In this embodiment, when vehicle barrier 40 is moved down (e.g., blocking access to a garage), light 22 may be illuminated red. When vehicle barrier 40 is moved up (e.g., does not block access to the garage), light 22 may be illuminated green.

In addition to the lights 22, audible warning devices may be mounted on any of the vehicle barriers or near them, such as an audible warning device 46 mounted on vehicle barrier 40 or wall 42. The audible warning device 46 may include, without limitation, a buzzer or siren that may warn of no access (e.g., when the light 22 is red).

In all the embodiments of the invention, lights 22 may work automatically in the dark, such as by means of a night sensor 48, shown in FIG. 4 (e.g., an optical sensor that turns on the lights 22 when the ambient light drops below a threshold). The lights 22 may be mounted on both sides of the barrier. This may be useful at the entrance to buildings where vehicles can approach the barrier from both sides thereof.

The scope of the present invention includes both combinations and subcombinations of the features described hereinabove as well as modifications and variations thereof which would occur to a person of skill in the art upon reading the foregoing description and which are not in the prior art.

What is claimed is:

1. An assembly comprising:

a vehicle barrier arranged for moving from a first position that permits a vehicle to move past the vehicle barrier to a second position that prevents a vehicle from moving past the vehicle barrier; and a light mounted on said vehicle barrier that moves with said vehicle barrier, wherein when said vehicle is in the first position said light is illuminated in a first color and in the second position said light is illuminated in a second color.

2. The assembly according to claim 1, wherein said vehicle barrier is movable to an intermediate position that partially prevents a vehicle from moving past the vehicle barrier, and wherein when said vehicle barrier is in the intermediate position said light is illuminated in a third color.

3. The assembly according to claim 1, wherein said first color is green.

4. The assembly according to claim 1, wherein said second color is red.

5. The assembly according to claim 4, wherein said third color is amber.

6. The assembly according to claim 1, wherein said light is a solar powered light and further comprising a solar cell for powering said light.

7. The assembly according to claim 1, wherein said vehicle barrier is pivoted such that when said vehicle barrier is in a vertical position a vehicle can move past the vehicle barrier.

8. The assembly according to claim 1, wherein said vehicle barrier is pivoted such that when said vehicle barrier is in a non-vertical position a vehicle can move past the vehicle barrier.

9. The assembly according to claim 1, wherein said vehicle barrier is arranged for moving horizontally between said first and second positions.

10. The assembly according to claim 1, wherein said vehicle barrier is arranged for moving vertically between said first and second positions.

11. The assembly according to claim 1, further comprising a night sensor operative to turn on said lights when ambient light drops below a threshold.

* * * * *